US006350294B1

(12) United States Patent
Renner et al.

(10) Patent No.: US 6,350,294 B1
(45) Date of Patent: Feb. 26, 2002

(54) POWDER-METALLURGICALLY PRODUCED COMPOSITE MATERIAL AND METHOD FOR ITS PRODUCTION

(75) Inventors: Gerd Renner; Udo Siefken, both of München (DE)

(73) Assignee: Louis Renner GmbH, Dachau (DE)

( * ) Notice: Subject to any disclaimer, the term of this patent is extended or adjusted under 35 U.S.C. 154(b) by 0 days.

(21) Appl. No.: 09/490,659

(22) Filed: Jan. 25, 2000

(30) Foreign Application Priority Data

Jan. 29, 1999 (DE) ..... 199 03 619

(51) Int. Cl.[7] ..... C22C 1/05; C22C 9/00; B22F 3/00

(52) U.S. Cl. ..... 75/247; 428/548; 419/12; 419/13; 419/14; 200/265; 200/266

(58) Field of Search ..... 75/228, 247; 419/30, 419/5, 6, 12, 13, 14; 428/548; 200/265, 266

(56) References Cited

U.S. PATENT DOCUMENTS

| | | | | |
|---|---|---|---|---|
| 4,517,033 A | * | 5/1985 | Okumura et al. | 148/432 |
| 4,626,282 A | * | 12/1986 | Naya et al. | 75/247 |
| 4,677,264 A | | 6/1987 | Okumura et al. | 200/144 B |
| 4,784,829 A | | 11/1988 | Okumura et al. | 420/428 |
| 5,246,480 A | * | 9/1993 | Haufe et al. | 75/236 |

FOREIGN PATENT DOCUMENTS

| | | |
|---|---|---|
| DE | 34 28 276 C2 | 2/1986 |
| DE | 35 43 586 C2 | 7/1986 |
| DE | 36 14 642 C2 | 10/1986 |
| DE | 38 29 250 A1 | 3/1990 |
| DE | 42 05 763 A1 | 8/1993 |
| DE | 199 03 619.5 | 1/1999 |
| EP | 0 083 245 | 7/1983 |
| EP | 0 668 599 A2 | 8/1995 |
| WO | WO 93/17441 | 9/1993 |

OTHER PUBLICATIONS

Falbe et al., eds., *Römpp Lexikon Chemie,* Georg Thieme Verlag, Stuttgart, Germany, Title page, publication page, and pp. 1943 and 2705 (1998).

Massalski et al., eds., *Binary Alloy Phase Diagrams, Second Edition, vol. 2,* ASM International , United States, Title page, publication page, and p. 1339 (1990).

* cited by examiner

*Primary Examiner*—Ngoclan Mai
(74) *Attorney, Agent, or Firm*—Mueting, Raasch & Gebhardt, P.A.

(57) ABSTRACT

The present invention relates to powder-metallurgically produced composite material comprising a matrix of a metal with a melting point of at most 1,200° C. and a granular additive which consists of at least two refractory components embedded in said matrix, characterized in that the refractory components are present as mixed crystals or intermetallic phases. In one embodiment of the invention one or a first group of refractory component(s) has a melting point in the range of 1,500 to 2,400° C. and the second or the second group of refractory component(s) has a melting point above 2,400° C. The composite material is produced by heating a pulverized mixture of the refractory components, thus converting it into a mixed crystal or an intermetallic phase, and then combining the powder obtained by cooling and pulverizing with a metal matrix having a melting point of at most 1,200° C. by means of powder-metallurgy. The composite material of the present invention is suitable as switching contact in electrical vacuum switch boxes.

9 Claims, 13 Drawing Sheets

CrW 70/30

100:1

100:1

100:1

200·1

POWDER-METALLURGICALLY PRODUCED COMPOSITE MATERIAL AND METHOD FOR ITS PRODUCTION

This application claims the benefit of priority German Application No. 199 03 619.5, filed Jan. 29, 1999.

The present invention relates to powder-metallurgically produced composite materials comprising a matrix with a granular additive embedded therein, which consists of at least two refractory components present as mixed crystals or intermetallic phases. Furthermore, the invention relates to a method for their production and their use as contact materials, preferably in electrical vacuum switch boxes.

Vacuum contact pads form the core in switch boxes of electrical vacuum switches and according to the prior art generally comprise an arc-resistant, granular component (refractory metals such as for example W, Mo or Cr) embedded in a metal matrix with a low melting point and a high conductivity (e.g. Ag, Cu, or alloys thereof). Contact materials have to meet high and sometimes contradictory demands, such as low material consumption,
sufficient breaking capacity,
low welding tendency,
low electrical resistance,
good disruptive strength (electric strength),
low break voltage.

CuCr composite materials have turned out to be especially suitable for vacuum power switches with an average voltage in the range of >12 kV to about 30 kV and higher. CuCr material have very favorable circuit breaking properties and a good electric strength (dielectric resolidification). The material consumption of CuCr materials is sufficiently low for the low number of 10,000 operations required in this range of performance.

In the low voltage range <1,000 V, the use of vacuum contactors is increasingly gaining importance. The contactor used in this range have to withstand 1,000,000 and more operations and the break voltage should be at as low a level as possible. Therefore, composite materials used for this purpose have to meet additional major requirements.

Efficient materials for this range include W/Cu, WC/Ag and WC/Cu in pure form or with further additives. In particular the matrix component Ag accounts for good current interrupting properties while the high-melting component W or WC minimizes the material consumption under the influence of an electric arc.

Due to the contradictory properties of the pure refractory components W and Cr, it is difficult to design contact materials for the remaining gap between 1,000 and 12,000 V which are able to meet the ever increasing requirements on switch boxes for vacuum contactors:

At an increasing voltage, the use of a pure tungsten component is limited by the increased tendency to emit electrons. This is due to the refractory nature of tungsten (melting point 3,410° C.). Thus, the electric strength in the vacuum is weakened.

At a low voltage on the other hand, the use of a pure Cr refractory component is limited by the poor resistance to material consumption which is due to the accumulated material consumption resulting from the large number of operations.

It would now be conceivable to synthetically adjust a refractory component which would have an optimal profile regarding the melting point (i.e. the resistance to material consumption with respect to the switching property) and the electron emission (i.e. electric strength) depending on the desired voltage range by mixing the two differently melting metal portions Cr and W. Thus, during the switching of electrical contacts, it should be possible to neutralize the negative properties of the contact materials used so far (in the case of Cr the high degree of material consumption due to the low melting point, in the case of W the high degree of electron emission or low electric strength due to the high melting point).

One possible approach of this kind is described in EP-A-0 083 245 which discloses, inter alia, a CuCrW alloy which is prepared in a manner known per se involving powder metallurgy by compressing the metal powder mixture and sintering in a solid or liquid Cu phase. It is the object of this reference to prepare as finely-grained a composite as possible. This object is to be achieved by creating a completely solid solution of the refractory metals in each other due to the metals W and Cr which crystallize in a cubic system.

In order to examine the usefulness of this teaching, CuCrW composites were prepared in accordance with the instructions in this reference. After sintering in a liquid Cu phase, the W grains are present in their original form and size coated by Cr. The W—Cr particles are embedded in the Cu matrix (FIG. 1). No mixed crystal of W and Cr of the type postulated in the reference could be detected. This is not surprising from a metallographic point of view since at the melting temperature of 1,100 to 1,200° C. (above the Cu liquidus) which has to be applied for that process, no reaction of tungsten and chromium could be expected.

X-ray fluorescence analysis of the material Cu 71% /Cr 24% /W 5% prepared according to the reference showed up until the limit of detection that the tungsten is not soluble in the ambient matrix of Cr and Cu. The summation analysis over a Cr area of $10\times14\ \mu m^2$ shows pure Cr, i.e. W is present in an amount below the limit of detection of <0,1% (FIG. 2). On the other hand, a diffusion of Cr into the W particles could not be verified, either: a local analysis shows pure W, i.e. Cr is present in an amount below the limit of detection of <0,1% (FIG. 3). Therefore, it seems as if a mutual penetration of the refractory metals Cr and W, i.e. the formation of a mixed crystal, cannot be realized. This reference does not provide a teaching to obtain improved switching properties by intimately mixing the refractory components Cr and W while taking advantage of the different properties of the two pure components.

Similarly, reference EP-A-0 668 599 discloses a contact material of CuCr with an additional auxiliary agent selected from the group consisting of tungsten, molybdenum, tantalum and niobium, which is obtained via diffusion of the refractory components in liquid copper phase and subsequent quenching as a fine-grained dispersion of the arc-resistant components in the Cu matrix.

With respect to a CuCrW material, a mutual diffusion of CrW as well as an arc-resistant grain of Cr and W is described. The invention is essentially directed to a fine-grained dispersion of the individual refractory components in the metal matrix. The formation of mixed crystals or intermetallic phases of the refractory constituents among each other is not described.

Thus, the requirements on materials for vacuum contactors to be used in the voltage range between 1,000 and 12,000 V are not met by the described mixtures of Cr and W in a Cu matrix.

It is therefore an object of the present invention to provide a composite material comprising a low melting, conductive matrix for example made from Cu or Ag and a granular additive of refractory components, which meets the mentioned requirements on vacuum power switches and vacuum contactors, i.e. which has both a high electric strength and thus a low electron emission and a high resistance to material consumption, and is therefore suitable for use in the voltage range of 1,000 to 12,000 V.

Another object of the invention is to provide a method for the production of such composite materials which can be carried out in an economically viable manner.

Finally, it is an object of the present invention to provide a composition material for the use as contact material, preferably as switching contact in electrical vacuum switch boxes in the voltage range of 1,000 to 12,000 V.

These objects were achieved based on the surprising finding that a material with advantageous properties is obtained if the refractory portion no longer consists of particles of one or more refractory components but if mixed crystals or intermetallic phases of at least two refractory components are present, wherein in a preferred embodiment these components have clearly different melting points. From a metallographic point of view the formation of an α-phase consisting of the pure or highly concentrated refractory component cannot always be avoided at certain weight ratios. It is, however, decisive that mixed crystals or intermetallic phases of the used refractory components are formed as well, which leads to clearly improved properties (e.g. low electron emission) of the composite material. Preferably, compositions should be selected which exclude the formation of α-phases.

According to the present invention, the desired material properties are not adjusted by sintering together, blending in additional components in the low-melting matrix or by mixing various high-melting powder components as is common in the prior art, but they are modified by means of prealloyed refractory components (present in the form of mixed crystals or intermetallic phases).

The present invention therefore relates to a powder-metallurgically produced composite material comprising a matrix from a metal with a melting point of at most 1,200° C. and a granular additive embedded in this matrix consisting of at least two refractory components, characterized in that the refractory components are present in the form of mixed crystals or intermetallic phases.

Preferred embodiments of the composite material of the present invention have been made the subject matter of the claims. Especially preferred is a composite material wherein one or a first group of refractory component(s) having a melting point in the range of 1,500 to 2,400° C. and the second or the second group of refractory component(s) having a melting point above 2,400° C.

Furthermore, a method for producing said composite material is provided characterized in that a pulverized mixture of at least two refractory components is converted into a mixed crystal or an intermetallic phase by heating and then the powder obtained by cooling and pulverizing is combined with a metal matrix having a melting point of at most 1,200° C. by means of a powder-metallurgical process.

Preferred embodiments of the process constitute the subject-matter of the claims.

A further subject-matter of the invention is the use of the mentioned composition material as electrical contact material, preferably as switching contact in electrical vacuum switch boxes, in particular in the voltage range of 1,000 to 12,000 V.

Figure 1:
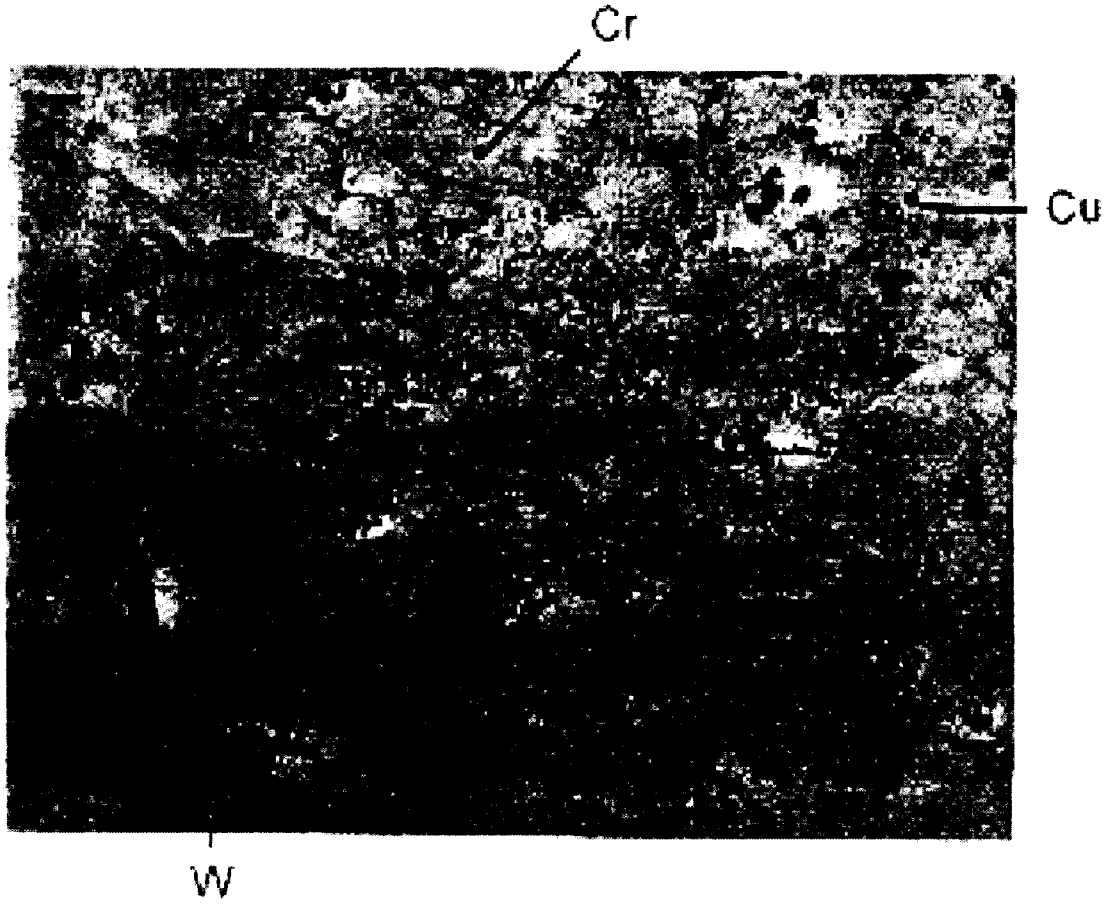
FIG. 1: a micrograph of a polished section of a Cu Cr W composite according to EP-A-0 083 245.
Figure 2:
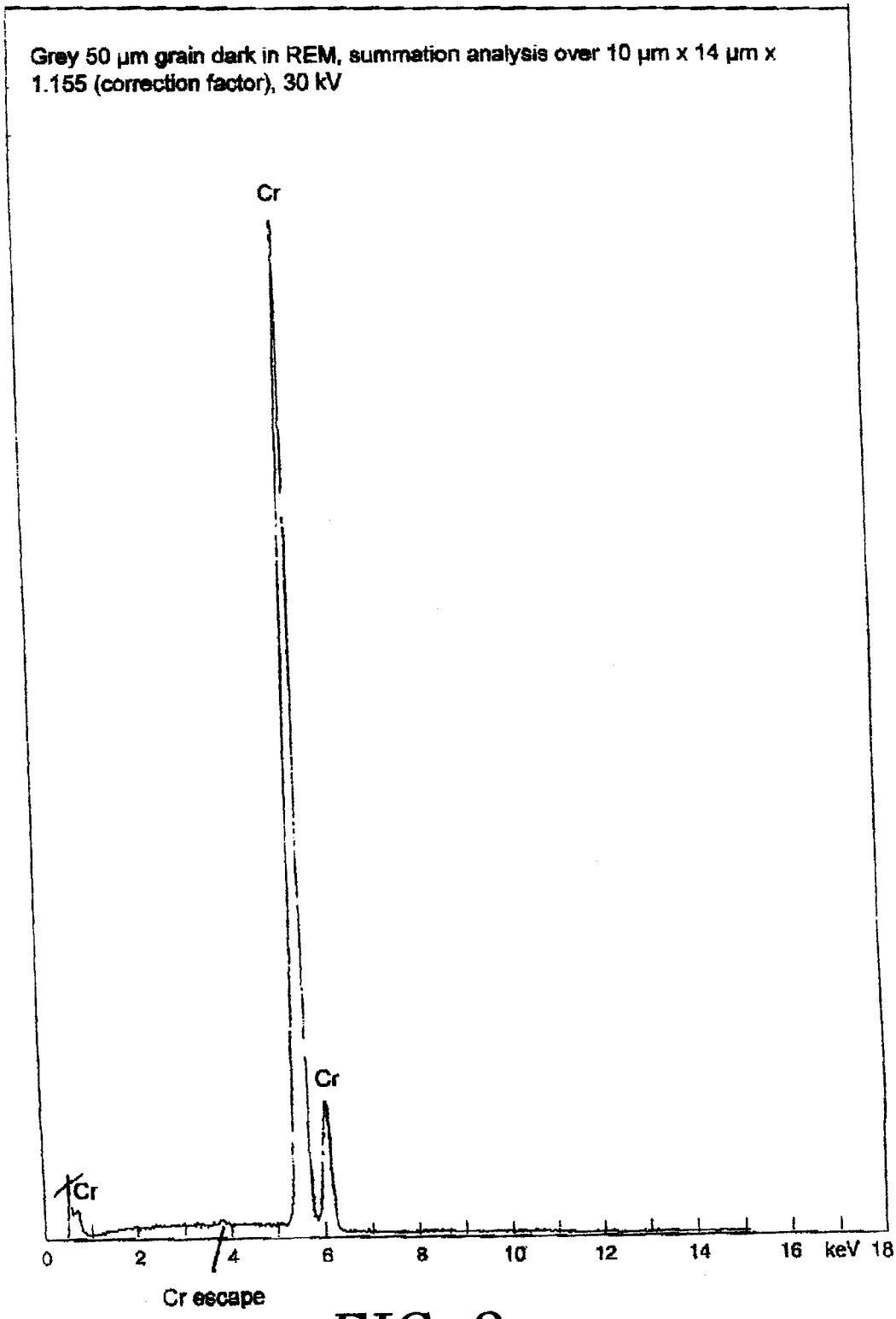
FIG. 2: an X-ray fluorescence summation analysis of Cr from the Cu Cr W composite according to EP-A-0 083 245.
Figure 3:
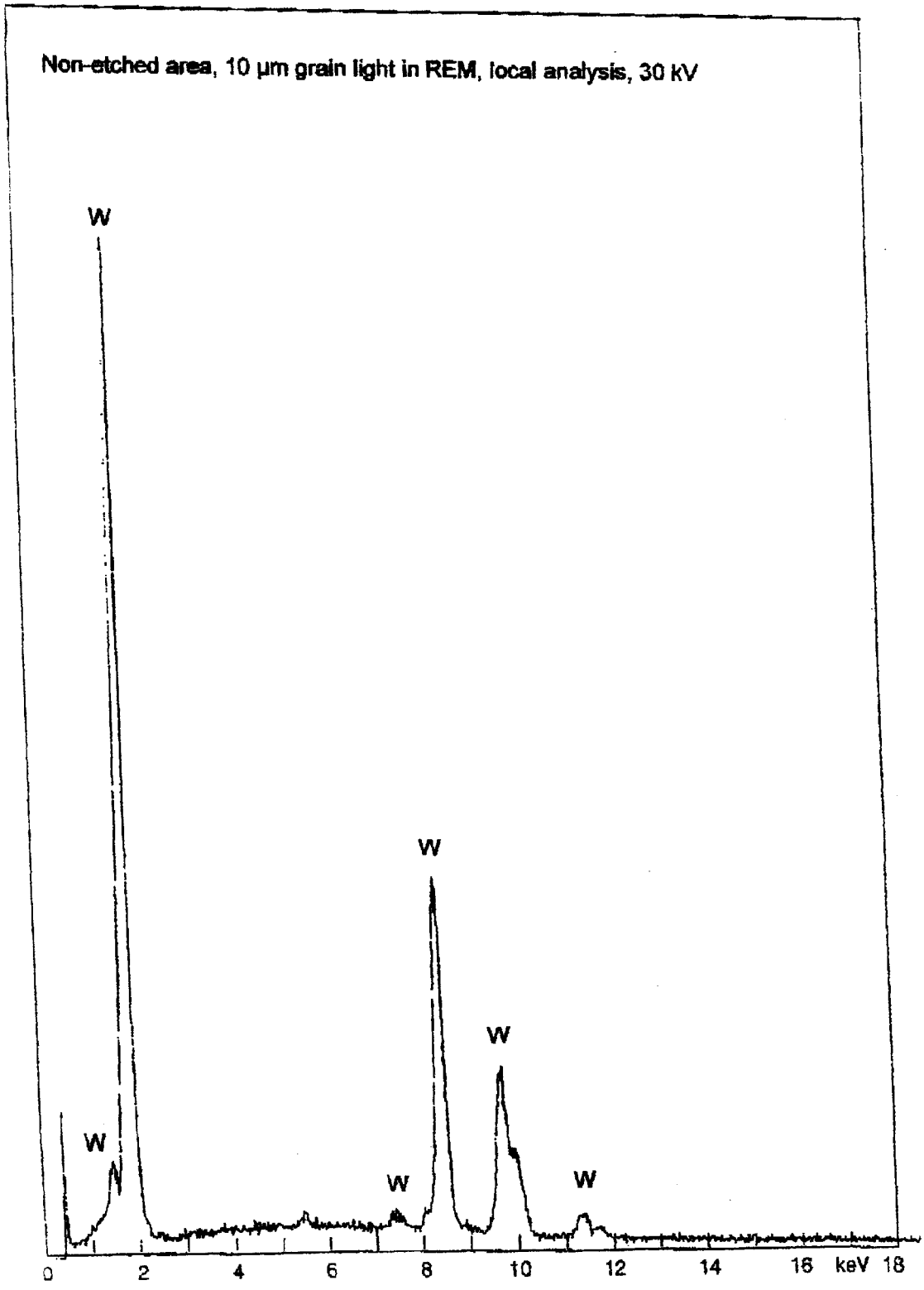
FIG. 3: an X-ray fluorescence local analysis of W from the Cu Cr W composite according to EP-A-0 083 245.

In the following, the invention will be described in detail.

The powder-metallurgically produced composite material of the present invention comprises a matrix from a metal with a melting point of at most 1,200° C. wherein a granular additive is embedded consisting of at least two refractory components, the refractory components being present in the form of mixed crystals or intermetallic phases of each other.

Suitable metals for the matrix of the composite material include comparatively low-melting metals having good electrical conductivity as they are commonly used for vacuum contact pads. Preferred matrix materials are Cu, Ag or Al. It is also possible to use alloys of these metals wherein the mass ratio is not crucial.

Examples of refractory components suitable for use in the composite material of the present invention include group Vb metals, namely V, Nb and Ta, and group VIb metal, namely Cr, Mo and W. In addition to the elementary form of these metals, nitrides, carbides, silicides or borides of these metals (in the following referred to as "hard material") can also be used, as well as mixtures thereof or mixtures of the hard materials with the metals. The use of the mentioned hard materials can have a positive influence on the properties of the composite material, for example its weight. Preferred refractory components are the metals Cr and W.

The mass ratio of the used refractory metals or hard materials is not crucial, as long as it is ensured that a mixed crystal or an intermetallic phase is obtained upon heating these components. Within the limits defined by this precondition, the mass ratios of the metals or hard materials may differ over a wide range. The present invention also encompasses a mass ratio wherein mixed crystals or intermetallic phases are only partly formed while an excess metal component partly remains as pure substance.

Preferably, the refractory portion comprises at least 1, preferably at least 5, more preferably at least 10 and in particular at least 50 wt.-% of mixed crystals and intermetallic phases. It is especially preferred that more than 90% of the refractory portion be present as mixed crystal or intermetallic phase, and in particular the entire refractory portion.

The term "mixed crystal" refers to homogeneous solid solutions of the refractory metals or hard materials, whose positions in the crystal lattice are occupied by the atoms of the various metals. The atoms with a small radius which form the hard materials can be included in interstitial positions of the metal host lattice; cf. *Römpp Lexikon Chemie* [Römpp chemistry encyclopedia], $10^{th}$ edition 1998, page 2705.

"Intermetallic phases" are chemical compositions of two or more metallic elements whose structure differs significantly from that of the metals. In addition to phases with a stoichiometrical composition corresponding to the existing valences, there are also phases wherein this exact composition only represents a special case in a wide homogeneity range. Special examples of the intermetallic phases are the Laves phases, Hume-Rothery phases and Zintl phases; cf. *Römpp Lexikon Chemie,* $10^{th}$ edition 1998, page 1943.

The amount of refractory components in the total mass of the composite material is not particularly crucial, however, it usually accounts for 15 to 80, preferably 25 to 50 wt.-%. Accordingly, the amount of matrix metals usually accounts for 20 to 85, preferably 50 to 75 wt.-%.

In a preferred embodiment of the invention, the composite material comprises at least one refractory component having a melting point in the relatively low range of 1,500 to 2,400° C. and at least one second refractory component having a relatively high melting point in the range of higher than 2,400° C. Examples of refractory components having a melting point in the former range include Cr and Nb, while examples of suitable refractory components having a melting point above 2,400° C. include the metals Ta, Mo and W sind. Preferably, the metal with a low melting point is Cr and the metal with a higher melting point is W. In this embodiment as well, the mass ratio of the refractory components is preferably such that, upon heating, at least a considerable part is converted into a mixed crystal or an intermetallic phase.

For practical reasons, it is desirable to select the amounts of the individual refractory components such that they can be melted together without involving the use of extensive machinery. Accordingly, mixtures comprise 10 to 90, preferably 30 to 70 wt.-% of the lower melting refractory component, e.g. chromium, and 10 to 90, preferably 30 to 70 wt.-% of the higher melting refractory component, e.g. tungsten. Particularly suitable is a mixture of about 70 wt.-% Cr and 30 wt.-% W. In particular, the amounts of refractory components are selected such that the higher melting refractory component in connection with the lower melting refractory component completely dissolves forming mixed crystals or intermetallic phases.

In a first step for the production of the composite material of the present invention, completely or almost completely homogeneous mixed crystals or intermetallic phases are formed by intimately mixing at least two pulverized refractory components, quickly melting the mixture by means of a suitable process which is able to generate a high energy density in the melt volume, homogenizing the mixture and quickly cooling it again without any segregation worth mentioning. The cooling rate should be higher than 100 K/min since otherwise the polygonal structure tends to segregate. The cooled melt cake is then crushed in a suitable manner and a mixed crystal powder of the desired grain size is screened out.

The obtained mixed crystal powder is processed further together with a low-melting matrix metal having good electrical conductivity by means of one of the following possibilities to form the desired composite material:

Solid-phase Sintering

A metal powder of the low-melting matrix and the obtained mixed crystal powder are mixed, compressed and sintered at a temperature below the melting point of the matrix metal, preferably under high vacuum.

Liquid-phase Sintering

The obtained mixed crystal powder is compressed and impregnated with the molten matrix metal, preferably under high vacuum.

Due to the preferred high vacuum treatment, the molded articles obtained from the sintering process are low in gas compared to articles conventionally sintered under protective gas, i.e. they contain reduced residual amounts of $O_2$, $N_2$ or $H_2$. These blank pieces are processed further by machining into the form of disks, rings or the like to give suitable contacts for the use in electrical vacuum switch boxes.

The composite material of the present invention can for example be used as contact material in electrical vacuum switch boxes. The composite materials of the present invention are particularly suitable for the use in a voltage range of 1,000 to 12,000 V, particularly the composite materials comprising at least one refractory component having a melting point in the range of 1,500 to 2,400° C. and at least one refractory component having a melting point above 2,400° C. comprising mixed crystals or intermetallic phases of these refractory components with melting points in one of the mentioned ranges.

The following examples, which are not restricting the present invention in any sense, describe some preferred embodiments of the invention:

EXAMPLE 1

Figure 4:
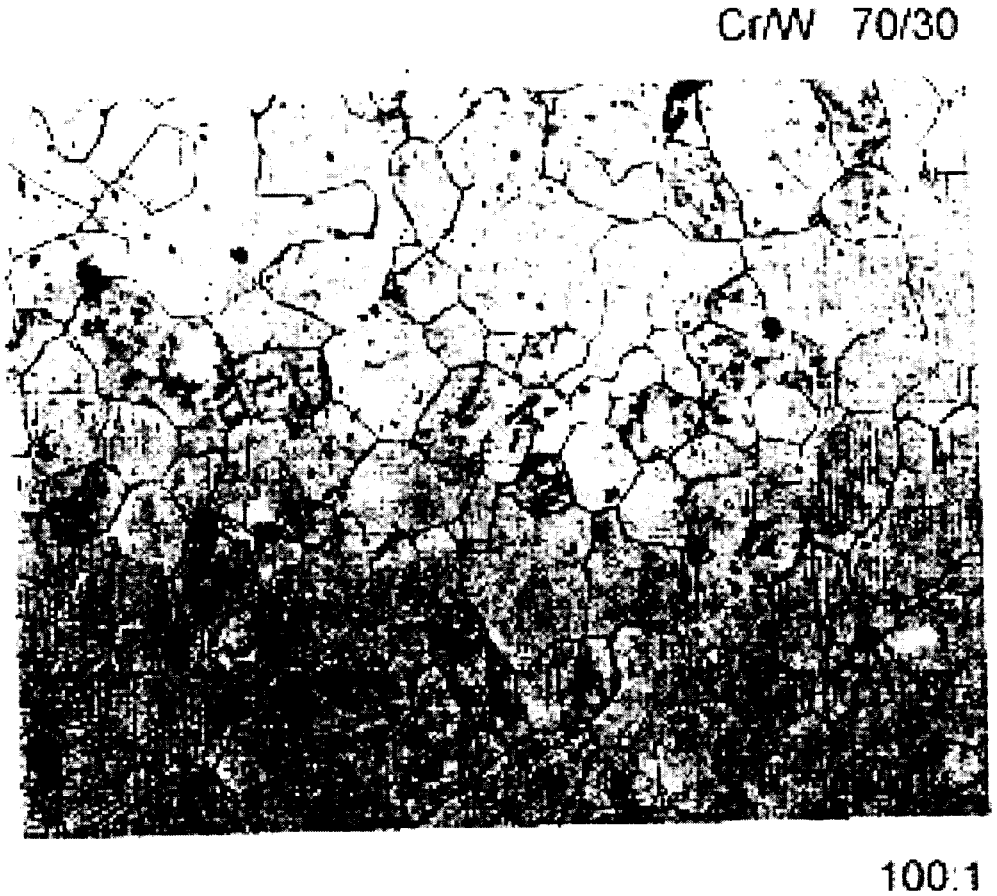
FIG. 4: a micrograph of a polished section of Cr W 70/30 mixed crystals from Example 1.

70 wt.-% Cr metal powder (Cr: ≧99.8 wt.-%) and 30 wt.-% W metal powder (W: ≧99.95 wt.-%) are mixed, compressed and melted together under vacuum or protective gas. The melt is quenched and made to solidify as quickly as possible (cooling rate >100 K/min). The obtained mixed crystals of W and Cr are almost homogeneous in their composition and only show weak inhomogeneity regarding the dispersion of the respective individual component. The solidified melt shows a uniformly polygonal grain structure (FIG. 4). The W and Cr metal grains used are completely dissolved in the melt and can no longer be detected in the melt cake.

Figure 5:
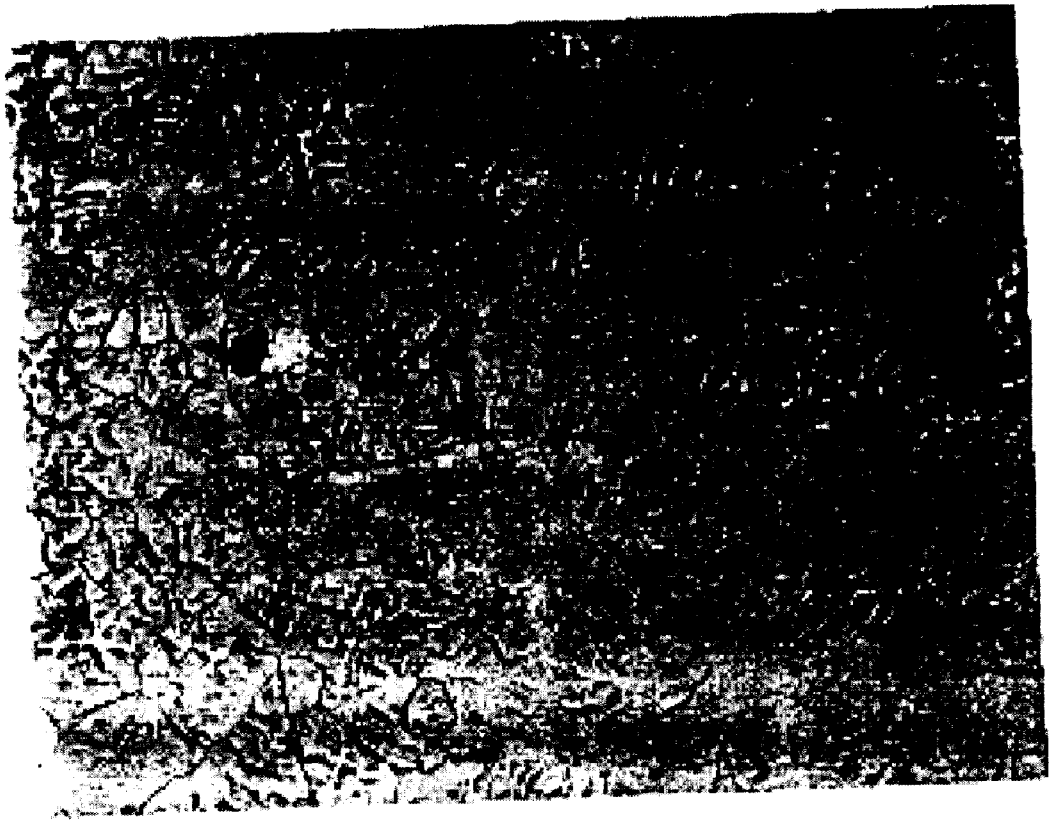
FIG. 5: a micrograph of a polished section of Cr W 70/30 mixed crystals with a dendritic substructure from Example 1.

At a low cooling rate (<100 K/min) the uniformly polygonal structure tends to segregate and a dendritic substructure forms (FIG. 5).

Figure 6:
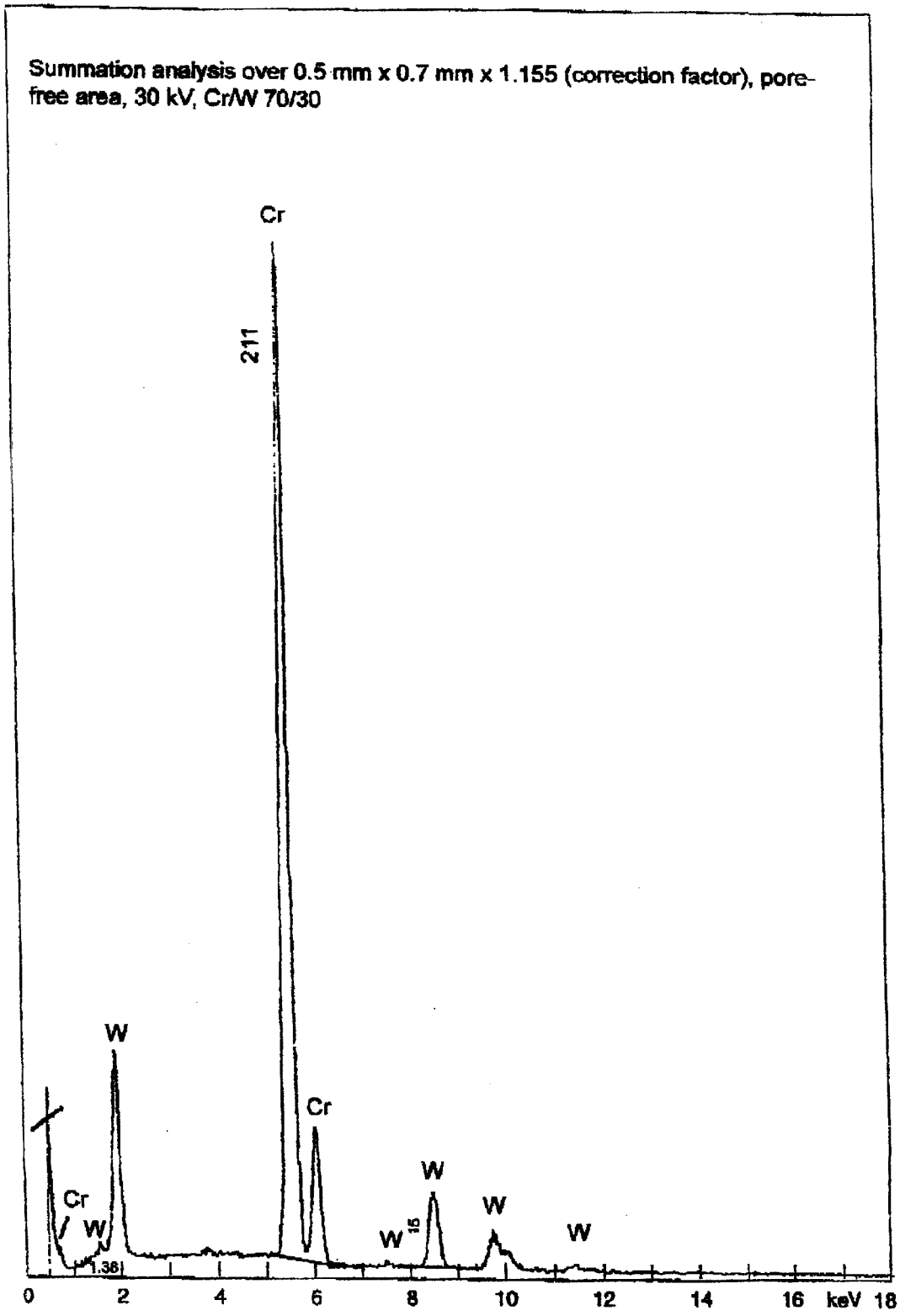
FIG. 6: an X-ray fluorescence summation analysis of Cr and W from CrW 70/30 mixed crystals from Example 1.
Figure 7:
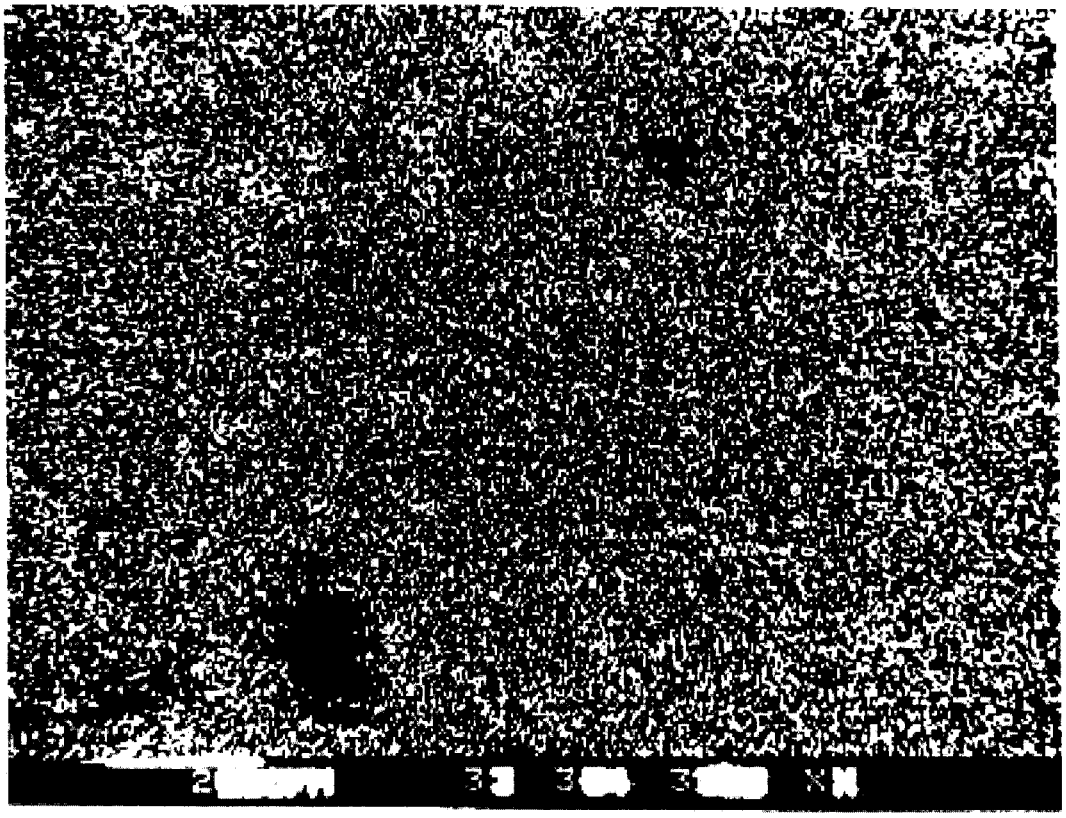
FIG. 7: a distribution analysis of W from Cr W 70/30 mixed crystals from Example 1; the white dots signify W, the large black spots are pores in the melt cake.

By means of electron-scanning microscopy these results can be confirmed as follows:

A summation analysis over a larger area of 0.5×0.7 $mm^2$ defines the weight ratio Cr/W as 70/30 corresponding to the initial quantity (FIG. 6). A distribution analysis of W in Cr shows an essentially uniform distribution of W in Cr (FIG. 7). This area corresponds to that of a uniformly polygonal structure like in FIG. 4.

Figure 8:
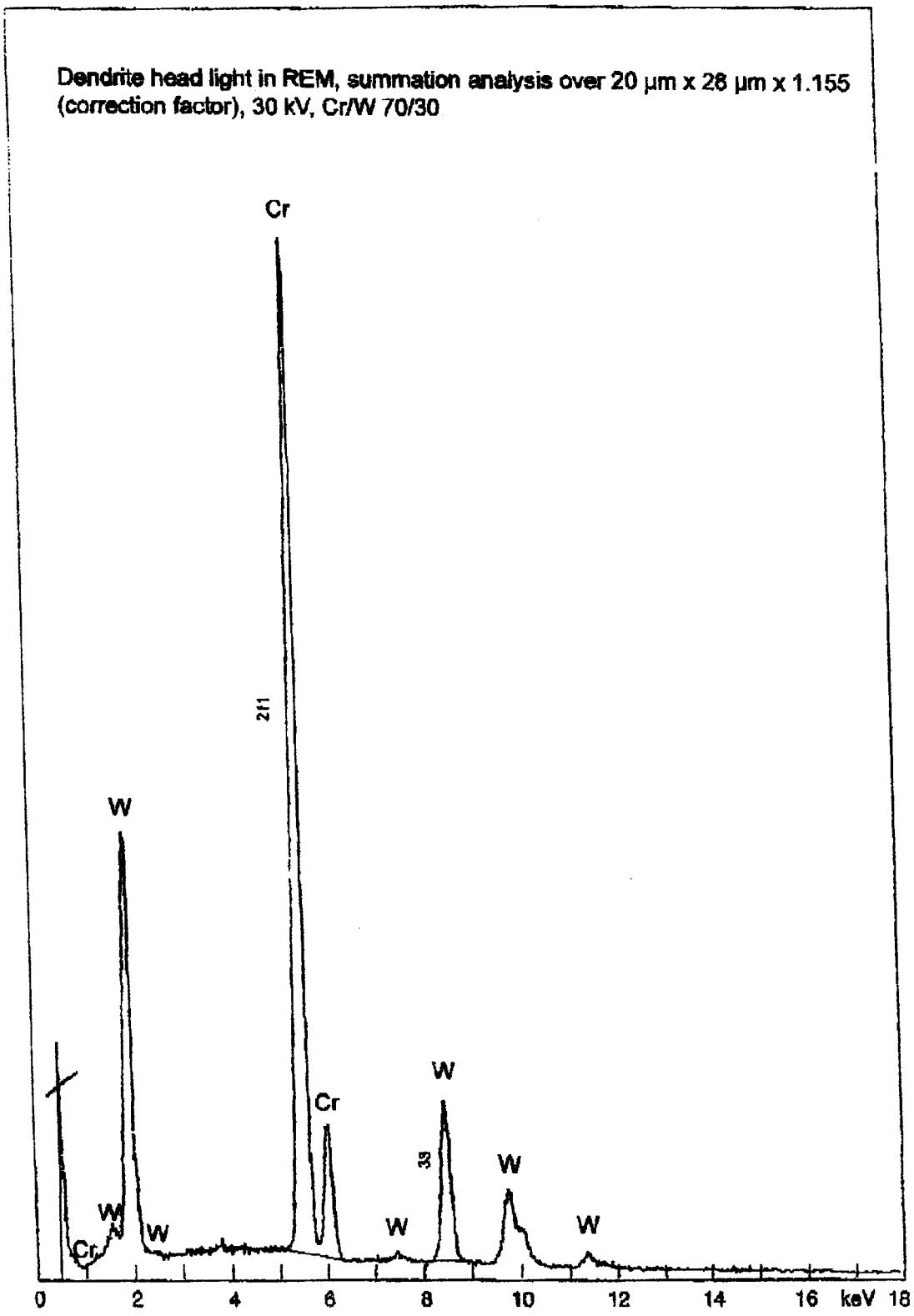
FIG. 8: an X-ray fluorescence summation analysis of Cr and W from CrW 70/30 mixed crystals with a substructure rich in chromium from Example 1.

Over a small area of 20×28 $\mu m^2$, a substructure in the form of a dendrite with Cr=54 and W=46 wt.-% the summation analysis reveals a maximal deviation from this ideal composition (FIG. 8). This area corresponds to a section of a mixed crystal having a substructure as in FIG. 5.

Then the melt cake is pre-crushed and ground. The obtained mixed crystal powder is screened to a size of ≦160

μm and sintered in a solid phase. For this purpose, 75 wt.-% Cu metal powder and 25 wt.-% of the obtained CrW mixed crystal powder are mixed, compressed and sintered under high vacuum at a temperature below the melting point of copper.

EXAMPLE 2

Figure 9:
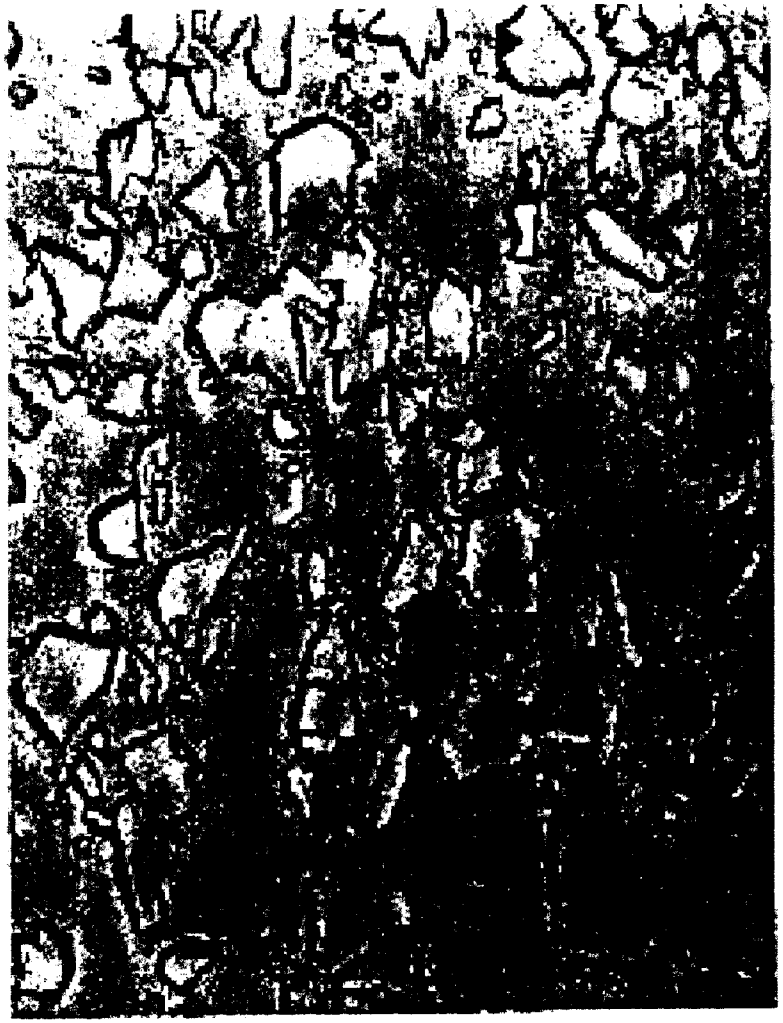
FIG. 9: a micrograph of a polished section of Cr W mixed crystals in Cu matrix from Example 2.

A CrW mixed crystal powder is prepared as described in Example 1, screened to a size of ≦160 μm and sintered in a liquid phase. For this purpose, the obtained CrW mixed crystal powder is compressed and impregnated with liquid copper under high vacuum such that a molded article with the composition Cu 60 wt.-% Cr/W 40 wt.-% is obtained (FIG. 9).

EXAMPLE 3

65 wt.-% Cr metal powder (Cr ≧99.8 wt.-%) and 35 wt.-% tantalum metal powder (Ta ≧99.9 wt.-%) are compressed and melted under vacuum or protective gas.

Figure 10:
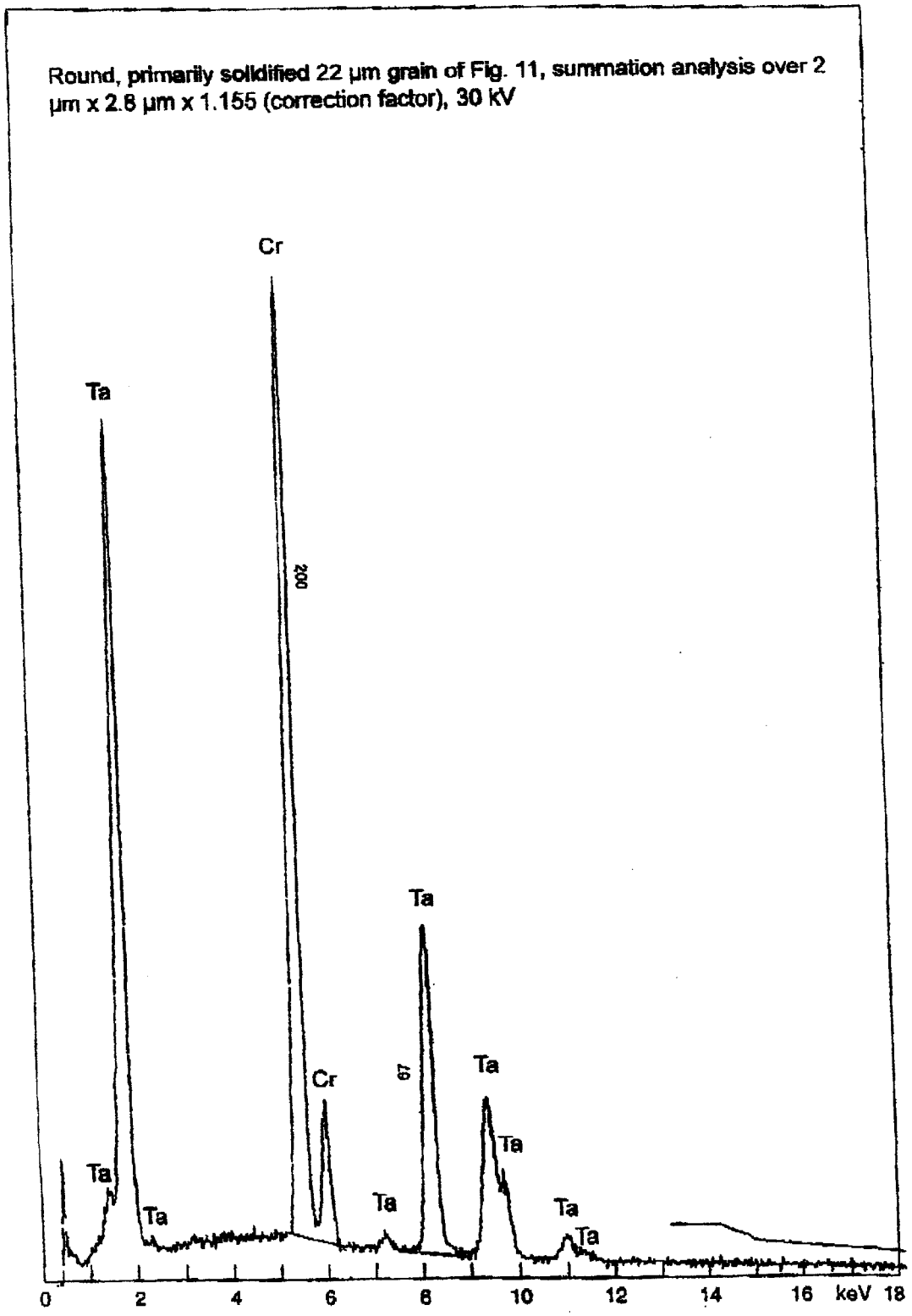
FIG. 10: an X-ray fluorescence summation analysis of an intermetallic $Cr_2Ta$ phase from Example 3.
Figure 11:
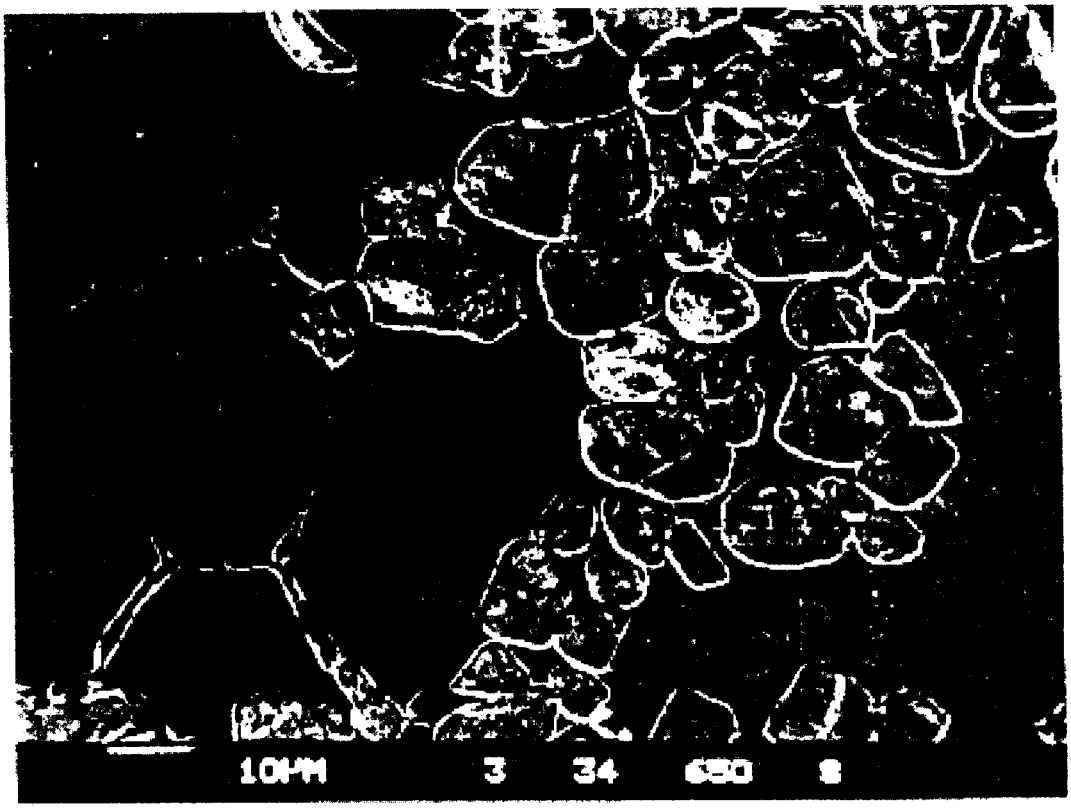
FIG. 11: an REM image of $Cr_2Ta$ grains in Cr matrix from Example 3.

An analysis of the obtained melt cake shows polygonal, primarily precipitated grains of the intermetallic phase $Cr_2Ta$ in the compound CrTa 37/63 wt.-% (corresponding to 67% of Cr atoms and 33% of Ta atoms) (cf. FIG. 10). They are surrounded by a Cr metal matrix (FIG. 11). This test result follows from the preselected composition of the green compact, comprising the metal components Cr and Ta close to the eutectic composition with ≈34 wt.-% tantalum (cf. Massalski et al, Binary Alloy Phase Diagrams, Second Edition Vol. 2, page 1339).

A starting compound richer in Ta up until a Ta content of 63–66 wt.-% increases the proportion of the $Cr_2Ta$ phase at the expense of the Cr phase to the point of pure $Cr_2Ta$.

As was described in Example 1 or 2, the melt cake is pulverized and processed together with Cu or Ag by means of a powder-metallurgical process to form a metal composite.

EXAMPLE 4

Figure 12:
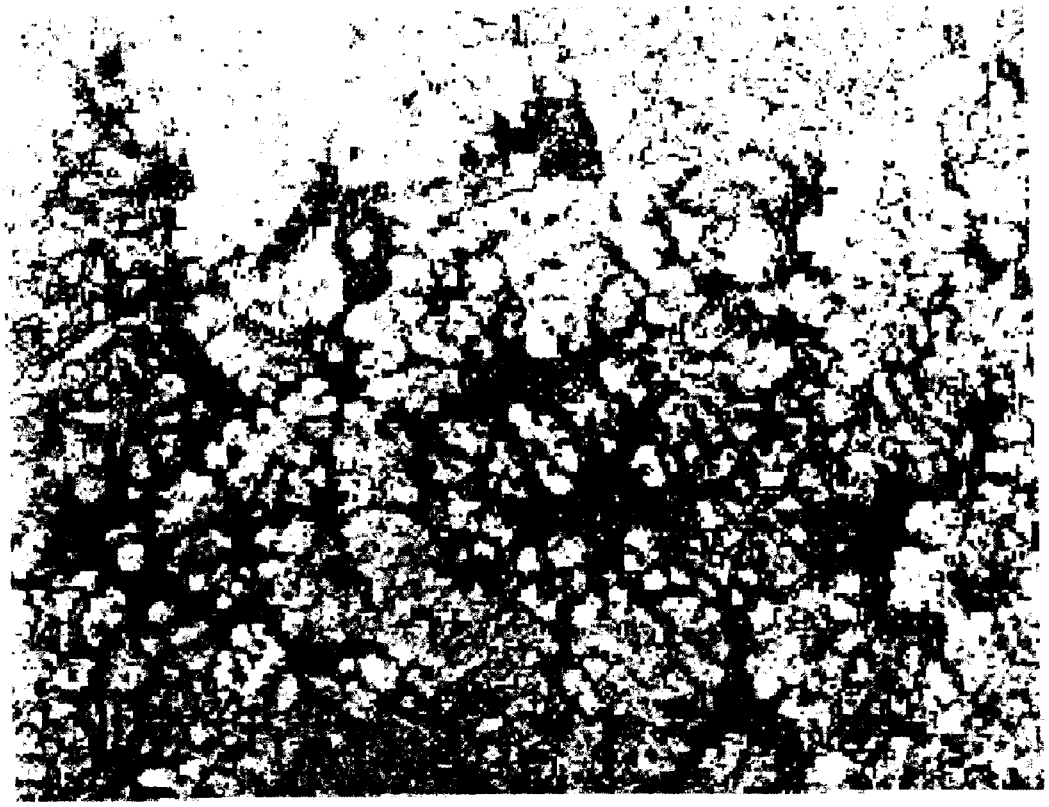
FIG. 12: a micrograph of a polished section of Cr W C 70/28.2/1.8 mixed carbide with a dendritic substructure from Example 4.

70 wt.-% Cr metal powder and 30 wt.-% WC powder are mixed, compressed and melted under vacuum or protective gas. The high-melting WC completely dissolves in the Cr melt that forms first. The melt cake solidifies as a CrW mixed carbide having the nominal composition Cr 70/W 28.2/C 1.8 wt.-%. Depending on the conduct of the solidification and cooling process, an metallographic analysis shows local inhomogeneities in the form of smaller or larger dendrites (FIG. 12). The higher melting refractory component WC has completed dissolved in the new mixed carbide.

Figure 13:
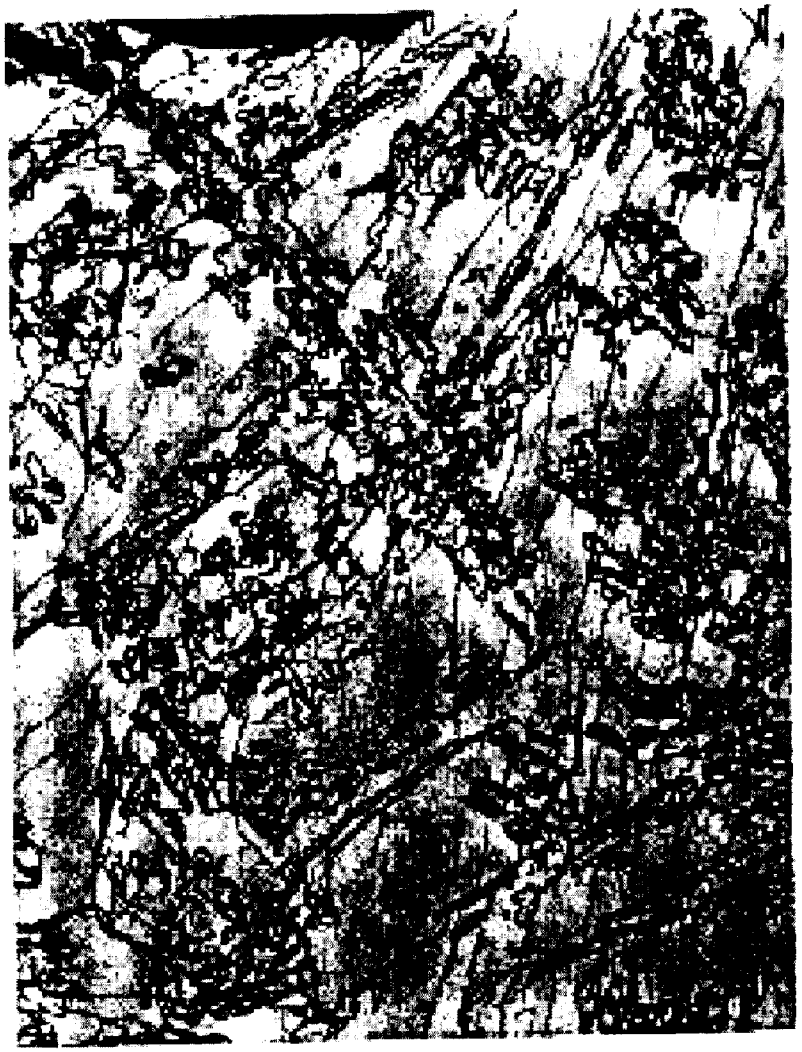
FIG. 13: a micrograph of a polished section of Cr W C 61/28/11 mixed carbide from Example 4.

The carbon content in the mixed carbide can be increased if the pure Cr metal is replaced with the comparatively low-melting $Cr_3C_2$ (melting point 1,850° C.). This corresponds to the prerequisite in claim 3. The melt cake then solidifies with a nominal composition of 61 wt.-% Cr, 28 wt.-% W and 11 wt.-% C (FIG. 13). Again, the original carbides dissolved completely in favor of a new mixed carbide.

As was described in Example 1 or 2, the melt cake is pulverized and processed together with Cu or Ag by means of a powder-metallurgical process to form a metal composite.

In a similar but not restricting manner, carbides such as VC, NbC, TaC and TiC, nitrides such as TiN and TaN, silicides such as $Ta_2Si$ and $V_3Si$ and borides such as $TiB_2$ can be used instead of the refractory components used herein.

EXAMPLE 5

As described in Example 4, further melt cake of the compositions CrNb 50/50 wt.-% and CrMo 70/30 wt.-% are mixed, compressed, melted, and subsequently crushed, separated by screening and processed further to give the respective composites with Cu or Ag.

What is claimed is:

1. A powder-metallurgically produced composite material comprising a matrix from a metal with a melting point of at most 1,200° C. and a granular additive embedded in this matrix comprising at least two refractory components;

wherein one or a first group of lower melting refractory component(s) has a melting point in the range of 1,500 to 2,400° C. and a second or a second group of higher melting refractory component(s) has a melting point above 2,400° C.;

wherein the refractory components are selected from group Vb (V, Nb, Ta) and group Vlb (Cr, Mo, W) metals, as well as their nitrides, carbides, silicides, borides and mixtures thereof, and TiC, TiN, and $TiB_2$;

wherein one of the lower melting refractory component(s) is Cr and one of the higher melting refractory component(s) is selected from the group of W, Mo, and WC; and wherein the refractory components comprise mixed crystals or intermetallic phases of each other.

2. The composite material according to claim 1, wherein the refractory components are present in an amount of 15–80 wt.-% and the matrix is present in an amount of 20–85 wt.-% based on the total weight of the composite material.

3. The composite material according to claim 1, wherein the higher melting refractory component in connection with the lower melting refractory component completely dissolves by forming mixed crystals or intermetallic phases.

4. The composite material according to claim 1, wherein the matrix consists of at least one of the metals Cu, Ag, and Al.

5. The composite material according to claim 1, wherein the lower melting refractory component is present in an amount of 10–90 wt.-%, based on the total weight of the refractory components.

6. A method for producing a composite material according to claim 1, comprising:

providing a mixture of at least two refractory components;

pulverizing the mixture of at least two refractory components;

heating the pulverized mixture of at least two refractory components to obtain a mixed crystal or an intermetallic phase;

cooling the mixed crystal or intermetallic phase;

pulverizing the mixed crystal or intermetallic phase to obtain a powder; and combining the powder with a metal matrix having a melting point of at most 1,200° C. by means of powder-metallurgy.

7. An electrical contact material comprising the composite material of claim 1.

8. A switching contact in electrical vacuum switch boxes comprising the composite material of claim 1.

9. The switching contact according to claim 8 which operates in the voltage range of 1,000 to 12,000 V.

* * * * *